United States Patent [19]

Kanzaka

[11] 4,048,699

[45] Sept. 20, 1977

[54] SLIDER FOR SLIDE FASTENER

[75] Inventor: Yoshihiro Kanzaka, Nyuzen, Japan

[73] Assignee: Yoshida Kogyo Kabushiki Kaisha, Japan

[21] Appl. No.: 645,837

[22] Filed: Dec. 31, 1975

[30] Foreign Application Priority Data

Jan. 15, 1975 Japan ..... 50-6782

[51] Int. Cl.[2] ..... A44G 19/30

[52] U.S. Cl. ..... 24/205.14 R

[58] Field of Search ..... 24/205.14 R

[56] References Cited

U.S. PATENT DOCUMENTS

| | | | |
|---|---|---|---|
| 2,172,217 | 9/1939 | Morin | 24/205.14 R |
| 2,189,727 | 2/1940 | Corner | 24/205.14 R |
| 2,274,723 | 3/1942 | Morin | 24/205.14 R |
| 2,289,585 | 7/1942 | Marinsky | 24/205.14 R |
| 2,301,792 | 11/1942 | Plumley | 24/205.14 R |
| 2,502,055 | 3/1950 | Marinsky | 24/205.14 R |
| 2,512,213 | 6/1950 | Morin | 24/205.14 R |

FOREIGN PATENT DOCUMENTS

| | | | |
|---|---|---|---|
| 417,781 | 10/1934 | United Kingdom | 24/205.14 R |

*Primary Examiner*—Bernard A. Gelak
*Attorney, Agent, or Firm*—Bucknam and Archer

[57] ABSTRACT

A slider for a slide fastener is assembled essentially with a slider body, a pull tab, a cap-like yoke and means for locking the slider against movement along a pair of rows of fastener elements. The slider body has an upper shield with a pair of first engaging means provided at its front and rear ends, respectively. The upper shield has a plurality of longitudinally extending grooves formed therein. The yoke has a pair of second engaging means at its front and rear end walls and has separated longitudinal bottom edges. The first engaging means interengage with the second engaging means and the lower edges of the yoke are fitted in the groove in the upper shield. The yoke has a projecting surface disposed for engagement with a concaved surface of the upper shield, both surfaces being fused together by ultrasonic welding to provide a rugged slider construction.

4 Claims, 3 Drawing Figures

SLIDER FOR SLIDE FASTENER

BACKGROUND OF THE INVENTION

1. Field of the Invention

This invention relates to sliders for slide fasteners and, more particularly, such a slider which essentially comprises a slider body, a pull tab, a yoke and/or a locking spring member housed in the yoke.

2. Prior Art

In the assembling of these slider components there have heretofore been known two typical methods of attaching the yoke to the slider body. One such method is to bring the yoke into snapping engagement with a bail or lug projecting upwardly from the slider body. The other method is to rivet the front and rear end walls and/or the side walls of the yoke into the bail. The first-mentioned method of slider assembly suffers from the drawback that the yoke is susceptible to disengagement from the slider body. The rivetting operation in the second-mentioned method is rather time-consuming and tedious and often involves off-specification products due to machining errors. Another difficulty with the latter method is that this method is unsuitable for processing large-size sliders having their pull tabs normally subjected to a relatively large pulling force during the manipulation of the slider.

SUMMARY OF THE INVENTION

With the foregoing deficiencies of the prior art sliders in view, a primary object of the present invention is to provide a slider which can be assembled with maximum ease and minimum machining errors.

Another object of the invention is to provide an improved slider which is reliable and durable in service, with its cap-like yoke attached fixedly to the slider body.

In accordance with the present invention, the upper shield of the slider body has a pair of first engaging means provided at its front and rear ends, respectively. The upper shield also has a plurality of grooves therein extending longitudinally of the slider body. A cap-like yoke has a pair of second engaging means provided at the front and rear end walls, respectively, of the yoke. The yoke also has a plurality of longitudinally elongated lower edges. The first engaging means are interengageable with the second engaging means with the lower edges of the yoke fitted into the grooves in the upper shield. The yoke has a surface disposed for engagement with that of the upper shield, both surfaces being fused together by ultrasonic welding to provide an integral joint.

Many other advantages and features of the present invention will become manifest to those versed in the art upon making reference to the detailed description and the accompanying sheet of drawings in which preferred structural embodiments incorporating the principles of the present invention are shown by way of illustrative example.

DETAILED DESCRIPTION OF THE PREFERRED EMBODIMENTS

Figure 1:
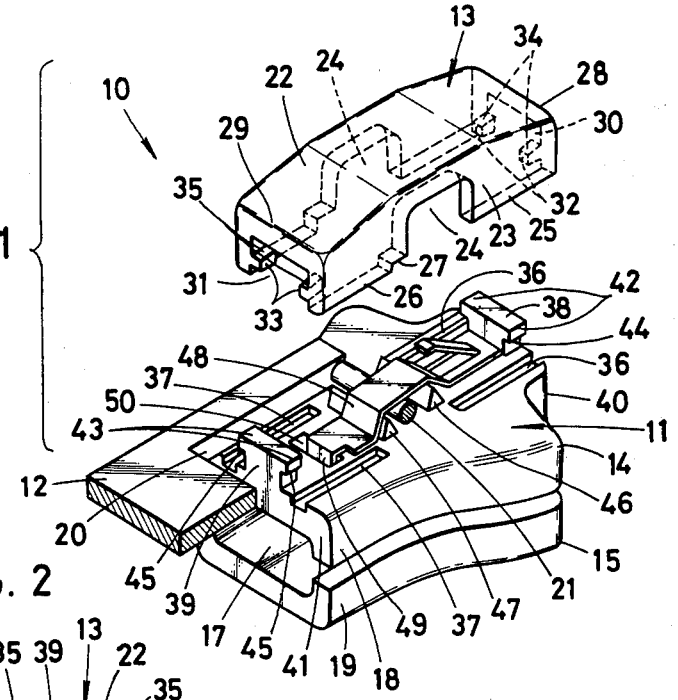
FIG. 1 is an exploded perspective view, with parts cut away, of a slider constructed in accordance with the invention.

FIG. 1 shows a slider of the automatically locking type generally designated at 10 and essentially comprising a slider body 11, a pull tab 12 and a yoke 13. The slider body 11 has an upper shield 14 and a lower shield 15 connected together at their front ends and in spaced opposed relation by an integral neck portion 16 (FIG. 2) to provide a substantially Y-shaped guide channel 17 for the passage therein of a pair of rows of fastener elements (not shown). A pair of flanges 18 extend downwardly from the upper shield 14 and a pair of flanges 19 extend upwardly from the lower shield 15, these flanges 18, 19 serving to retain the fastener elements in the Y-shaped guide channel 17 during longitudinal movement of the slider 10 along the rows of interlocking fastener elements (not shown) to open or close the slide fastener in the well known manner.

The pull tab 12 generally rectangular in shape is apertured at 20 to provide at one end a transversely extending pintle 21 which functions as an axis for the pivotal movement of the pull tab 12.

The yoke 13 has the shape of an elongated hollow cap and has an upper portion 22 and two longitudinal side walls 23 directed downwardly therefrom. Each side wall 23 is provided at or near its center a recess 24 extending upwards from the bottom edge of the respective side wall. The yoke 13 thus provides a pair of front bottom flange edges 25 and a pair of rear bottom flange edges 26 each having at its front end a stepped portion 27 for reasons described later.

Front and rear end walls 28, 29 have formed therein cutaway recesses 30, 31, respectively. A pair of transversely opposed ridges 32 project from the side wall 23 into the front recess 30. Similarly, a pair of transversely opposed ridges 33 project from the side walls 23 into the rear recess 31. The front ridges 32 have engaging top surfaces 34 downgraded towards the rear end of the yoke and the rear ridges 33 have similar engaging top surfaces 35 downgraded towards the yoke rear end.

The upper shield 14 has a pair of spaced front grooves or indents 36 and a pair of spaced rear grooves or indents 37, these grooves being formed in the upper shield 14 and extending longitudinally of the slider body 11. The front and rear grooves 36, 37 are so dimensioned as to fit with the front and rear bottom edges 25, 26, respectively, of the yoke 13.

A pair of substantially T-shaped, front and rear projections 38, 39 respectively extend upwardly from the front and rear ends 40, 41 of the upper shield 14, and have lateral flanges 42, 43 providing engaging undersurfaces 44, 45, respectively, and are adapted to fit in the cut-away recesses 30, 31, respectively. The undersurfaces 44, 45 are sloped downwardly so as to fit snugly with the ridge top surfaces 34 and 35, respectively.

A pair of spaced, transversely extending protrusions 46, 47 of triangular cross section are formed on the upper shield 14 and extend intermediate the grooves 36 and 37. The pintle 21 is disposed between the protrusions 46 and 47. A spring member 48 is placed on the upper shield 14 and extends longitudinally across the protrusions 46, 47 and the pintle 21. The spring member 48 has at one end a locking prong 49 directed downwardly therefrom through an aperture 50 in the upper shield 14 and movable into and out of engagement with the fastener elements within the slider body 11.

For the assembling of the component members of the slider 10, the pull tab 12 and then the spring member 48 are placed on the upper shield 14. Then, the yoke 13 is placed on the upper shield 14 with the front and rear bottom edges 25, 26 inserted in the front and rear grooves 36, 37, respectively. In this instance, the yoke 13 proper is slightly displaced longitudinally toward the front slider end 40 so as to facilitate the insertion of the bottom edges 25, 26 through the function of the stepped portions 27 which then ride on the front edges of the rear grooves 37. The yoke 13 is slid in and along the grooves 36, 37 toward the slider rear end 41 until the front and rear ridges 32, 33 engage with the lateral flanges 42, 43, respectively, with the top surfaces 34, 35 fully brought into abutment with the undersurfaces 44, 45, respectively.

Figure 2:
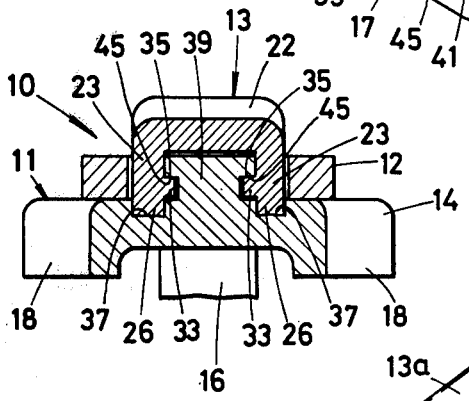
FIG. 2 is a fragmentary, transverse cross-sectional view of the slider of FIG. 1 taken when the same has been assembled.

The yoke 13 is fixed to the upper shield 14 by means of for example ultrasonic welding. More specifically, as shown in FIG. 2, the yoke 13 and the upper shield 14 are melted along their respective engaging surfaces and joined together by applying ultrasonic vibrations under pressure to provide an integral joint.

Figure 3:
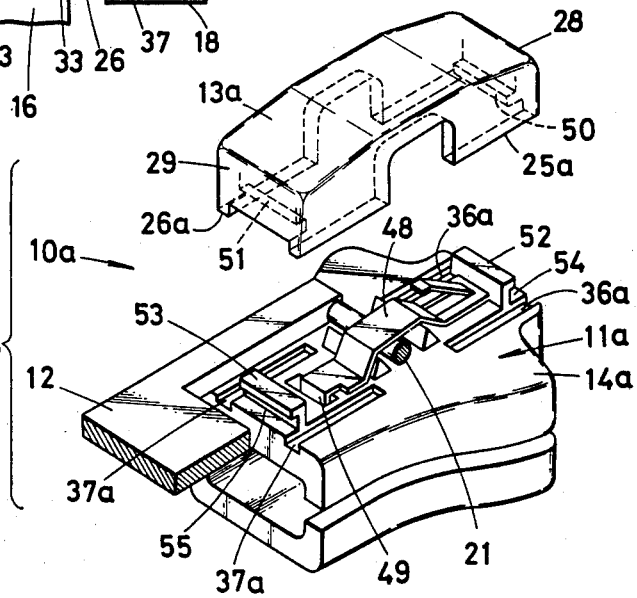
FIG. 3 is a view similar to FIG. 1 but showing another embodiment of the invention.

In FIG. 3, there is shown a slider 10a constructed according to another embodiment of the invention in which a pair of flanges 50, 51 project from the front and rear wall 28, 29, respectively, into the interior of the cap-like yoke 13*a.* A pair of cross-sectionally hook-shaped flanges 52, 53 have forwardly and rearwardly opening channels 54, 55, respectively, and project upwardly from the upper shield 14*a* at the front and rear slider ends 40, 41, respectively, the flanges 52, 53 being adapted to interengage with the flanges 50, 51, respectively. When assembling the yoke 13*a* onto the slider body 11*a,* it is pressed against the upper shield 14*a* until the flanges 50, 51 are snapped into the channels 54, 55, respectively, with the lower edges 25*a,* 26*a* of the yoke 13*a* inserted in the grooves 36*a,* 37*a,* respectively. Then, the yoke 13*a* is fixed to the upper shield 14*a* by means of ultrasonic welding.

Where the sliders are made out of metal, electric resistance welding or high-frequency induction welding can be used to secure the yoke firmly into position on the slider body. While the embodiments of FIGS. 1 and 3 illustrate automatically locking sliders, it will be understood that the principles of the present invention may also be applied to non-locking sliders having cap-like yokes.

Advantageously, the yoke 13 (13*a*) is mounted securely in place on the slider body 11 (11*a*) by bringing the ridges 34, 35 (FIG. 1) or the flanges 50, 51 (FIG. 3) into engagement with the projections 38, 39 (FIG. 1) or the flanges 52, 53 (FIG. 3). The joint between the yoke 13 (13*a*) and the slider body 11 (11*a*) is further strengthened by welding as above stated. During welding operation, the yoke 13 (13*a*) is held stably in position by the above interfitting parts against accidental displacement which would otherwise be caused by vibrations or other external forces as applied by an ultrasonic horn or other processing devices, or by the biasing force of the spring member 48 disposed within the yoke 13 (13*a*).

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slider for a slide fastener comprising: a slider body including an upper and a lower shield and having a front and a rear end, said shields being connected together by a neck portion at the front end, said upper shield having a plurality of grooves therein extending longitudinally of the slider body; a pull tab having at one end a pintle pivotally connected to said upper shield; a pair of first engaging means provided at the front and rear ends lying along the longitudinal axis of said slider, respectively of said upper shield; a yoke of a caplike shape mounted on said upper shield and having an upper portion, a pair of longitudinal side walls and a pair of front and rear end walls, said side walls having cut-away recesses through which said pintle extends and providing separated bottom edges engageable in said grooves; and a pair of second engaging means provided at the front and rear end walls respectively, of said yoke and interfitting with said first engaging means, said yoke and upper shield being integrally bonded together along their respective engaging surfaces, said first engaging means including upwardly extending projections having laterally and outwardly extending members, said second engaging means also including laterally extending members that engage said laterally extending members of the first engaging means to establish a given positional relation between the yoke and upper shield, said laterally extending members of said first and second engaging means being located in spaced-apart relation to said longitudinally extending grooves.

2. A slider according to claim 1 in which said first engaging means are substantially T-shaped projections each having a pair of lateral flanges, and said second engaging means are opposed ridges projecting into cut-away recesses formed in said front and rear end walls of the yoke.

3. A slider according to claim 1 in which said first engaging means are cross-sectionally hook-shaped flanges having forwardly and rearwardly opening channels, and said second engaging means are flanges projecting from said front and rear end walls into the interior of the yoke.

4. A slider according to claim 1 including a spring member disposed within said yoke and having at one end a locking prong directed downwardly through an aperture formed in said upper shield.

* * * * *